US011469519B1

(12) United States Patent
Georgakopoulos et al.

(10) Patent No.: US 11,469,519 B1
(45) Date of Patent: Oct. 11, 2022

(54) ANTENNA ARRAYS WITH THREE-DIMENSIONAL RADIATING ELEMENTS

(71) Applicants: Stavros Georgakopoulos, Miami, FL (US); Abdul-Sattar Kaddour, Miami, FL (US)

(72) Inventors: Stavros Georgakopoulos, Miami, FL (US); Abdul-Sattar Kaddour, Miami, FL (US)

(73) Assignee: THE FLORIDA INTERNATIONAL UNIVERSITY BOARD OF TRUSTEES, Miami, FL (US)

( * ) Notice: Subject to any disclaimer, the term of this patent is extended or adjusted under 35 U.S.C. 154(b) by 0 days.

(21) Appl. No.: 17/340,586

(22) Filed: Jun. 7, 2021

(51) Int. Cl.
*H01Q 21/06* (2006.01)
*H01Q 1/36* (2006.01)
*H01Q 1/48* (2006.01)

(52) U.S. Cl.
CPC ..... *H01Q 21/061* (2013.01); *H01Q 1/36* (2013.01); *H01Q 1/48* (2013.01)

(58) Field of Classification Search
CPC .... H01Q 1/36–52; H01Q 15/14; H01Q 19/10; H01Q 21/06
See application file for complete search history.

(56) References Cited

U.S. PATENT DOCUMENTS

| | | | | |
|---|---|---|---|---|
| 3,649,394 | A * | 3/1972 | Erickson | H05K 3/20 216/13 |
| 4,291,312 | A * | 9/1981 | Kaloi | H01Q 21/065 343/700 MS |
| 7,420,522 | B1 * | 9/2008 | Steinbrecher | H01Q 17/008 343/893 |
| 10,734,717 | B2 * | 8/2020 | Hosseini | H01Q 1/40 |
| 2003/0210207 | A1 * | 11/2003 | Suh | H01Q 21/26 343/895 |
| 2005/0156804 | A1 * | 7/2005 | Ratni | H01Q 9/28 343/773 |
| 2006/0001591 | A1 * | 1/2006 | Graggs | H01Q 11/08 343/895 |
| 2019/0109103 | A1 * | 4/2019 | Chiang | H01Q 1/36 |
| 2021/0376463 | A1 * | 12/2021 | Massman | H01Q 21/064 |

* cited by examiner

*Primary Examiner* — Hasan Islam
(74) *Attorney, Agent, or Firm* — Saliwanchik, Lloyd & Eisenschenk

(57) ABSTRACT

Antenna arrays with three-dimensional (3D) radiating elements are provided, as well as methods of manufacturing and methods of using the same. An array can include a ground plane and a plurality of radiating elements disposed thereon, and at least a portion of the radiating elements of the plurality of radiating elements can be 3D radiating elements. The array can optionally include a substrate disposed on the ground plane and having holes for the radiating elements. The 3D radiating elements can include, for example, conical elements such as a hollow conical element, a full conical element, a hollow and discretized conical element, or a combination thereof.

16 Claims, 8 Drawing Sheets

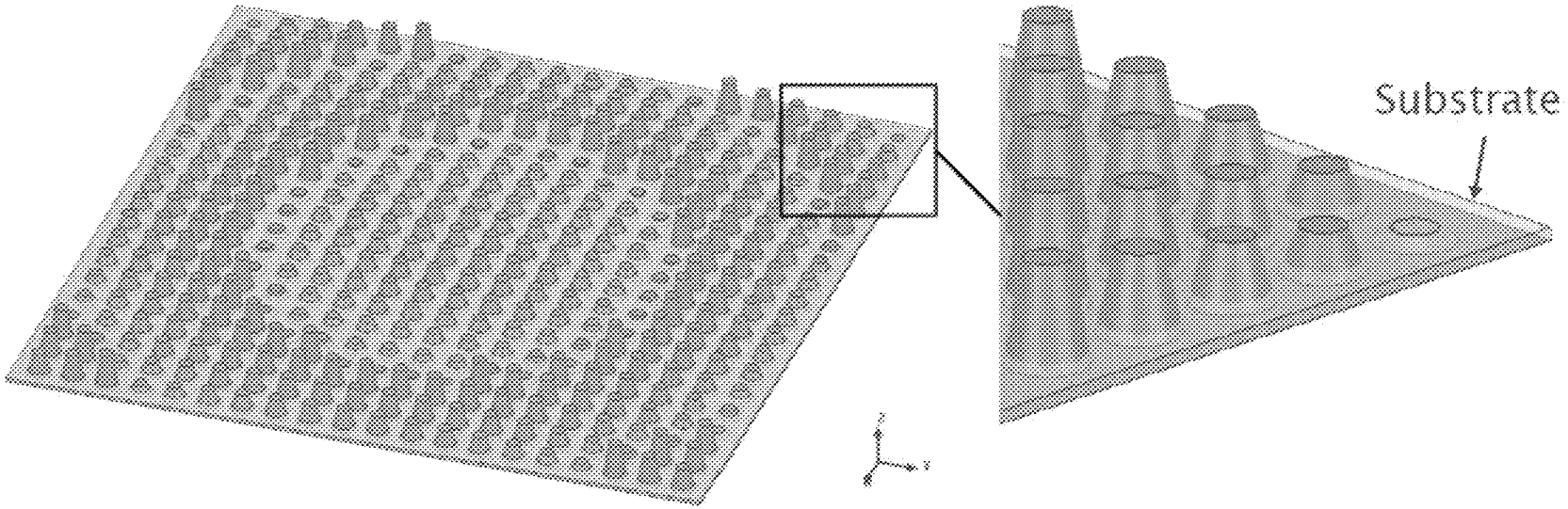
FIG. 8A
FIG. 8B
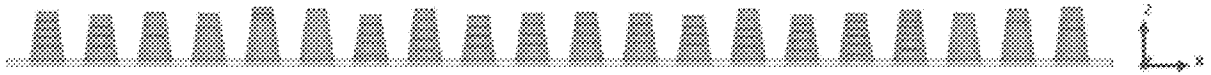
FIG. 8C

ANTENNA ARRAYS WITH THREE-DIMENSIONAL RADIATING ELEMENTS

GOVERNMENT SUPPORT

This invention was made with government support under FA9550-19-1-0290 awarded by Air Force Office of Scientific Research. The government has certain rights in the invention.

BACKGROUND

Antenna arrays, including transmitarrays and reflectarrays, are used in many fields, including satellite communications systems, military communications systems, and civilian communication systems. Existing arrays are generally narrowband, with a bandwidth of around 6%, and are also typically flat.

BRIEF SUMMARY

Embodiments of the subject invention provide novel and advantageous antenna arrays (e.g., reflectarrays and transmitarrays) with three-dimensional (3D) radiating elements, as well as methods of manufacturing and methods of using the same. An array can include a ground plane and a plurality of radiating elements disposed thereon, and at least a portion of the radiating elements of the plurality of radiating elements can be 3D radiating elements. The array can optionally include a substrate disposed on the ground plane and having holes for the radiating elements. The 3D radiating elements can include, for example, conical elements such as a hollow conical element, a full conical element, a hollow and discretized conical element, or a combination thereof. The conical elements can either be standard (with the side having the smaller radius or width of the cross-sectional shape of the element being on the ground plane) or inverted (with the side having the larger radius or width of the cross-sectional shape of the element being on the ground plane). The final radiating elements can comprise a conductive material, including but not limited to copper, silver, aluminium, gold, platinum, palladium, and/or steel. The array can be made by, for example, printing it (e.g., 3D printing) with a polymer (e.g., a plastic such as a thermoplastic and/or amorphous polymer such as acrylonitrile butadiene styrene (ABS)) or a similar material. The array can then be metallized with one or more metals (e.g., copper, silver, aluminium, gold, platinum, palladium, and/or steel).

In an embodiment, an antenna array can comprise: a ground plane; and a plurality of 3D radiating elements disposed on the ground plane, each 3D radiating element comprising a conductive material. The antenna array can be a reflectarray or a transmitarray. Each 3D radiating element of the plurality of 3D radiating elements can comprise a polymer coated with the conductive material. The conductive material can comprise, for example, at least one of copper, silver, aluminium, gold, platinum, palladium, and steel. The polymer can be a thermoplastic and/or an amorphous polymer. The ground plane can comprise a plurality of unit cells, each unit cell of the plurality of unit cells comprising exactly one 3D radiating element of the plurality of 3D radiating elements. Each 3D radiating element of the plurality of 3D radiating elements can be a conical element. For example, each 3D radiating element of the plurality of 3D radiating elements can be: a) a hollow conical element disposed on the ground plane such that a greatest width of a cross section of the hollow conical element, taken parallel to an upper surface of the ground plane, increases as it moves away from the ground plane; b) a filled-in conical element disposed on the ground plane such that a greatest width of a cross section of the hollow conical element, taken parallel to an upper surface of the ground plane, increases as it moves away from the ground plane; c) a hollow conical element disposed on the ground plane such that a greatest width of a cross section of the hollow conical element, taken parallel to an upper surface of the ground plane, decreases as it moves away from the ground plane; or d) a filled-in conical element disposed on the ground plane such that a greatest width of a cross section of the hollow conical element, taken parallel to an upper surface of the ground plane, decreases as it moves away from the ground plane. In each case (a-d), the cross section of each 3D radiating element of the plurality of 3D radiating elements can be a circle, with the greatest width being a diameter of the circle, or the cross section of each 3D radiating element of the plurality of 3D radiating elements can be a polygon (e.g., a hexagon). The antenna array can further comprise a substrate (e.g., a printed circuit board (PCB) substrate or a dielectric substrate) disposed on the ground plane and having a plurality of holes therein for the plurality of 3D radiating elements, respectively. The substrate can be in direct physical contact with the ground plane, the plurality of 3D radiating elements, or both.

In another embodiment, a method of fabricating an antenna array that comprises a ground plane and a plurality of 3D radiating elements disposed on the ground plane can comprise the steps of: using a 3D printer to print the ground plane and the plurality of 3D radiating elements with a polymer; and metallizing the ground plane and the plurality of 3D radiating elements with a conductive metal. The antenna array can be a reflectarray or a transmitarray. The conductive metal can comprise, for example, at least one of copper, silver, aluminium, gold, platinum, palladium, and steel. The polymer can be a thermoplastic and/or an amorphous polymer. The ground plane can comprise a plurality of unit cells, each unit cell of the plurality of unit cells comprising exactly one 3D radiating element of the plurality of 3D radiating elements. Each 3D radiating element of the plurality of 3D radiating elements can be a conical element. For example, each 3D radiating element of the plurality of 3D radiating elements can be: a) a hollow conical element disposed on the ground plane such that a greatest width of a cross section of the hollow conical element, taken parallel to an upper surface of the ground plane, increases as it moves away from the ground plane; b) a filled-in conical element disposed on the ground plane such that a greatest width of a cross section of the hollow conical element, taken parallel to an upper surface of the ground plane, increases as it moves away from the ground plane; c) a hollow conical element disposed on the ground plane such that a greatest width of a cross section of the hollow conical element, taken parallel to an upper surface of the ground plane, decreases as it moves away from the ground plane; or d) a filled-in conical element disposed on the ground plane such that a greatest width of a cross section of the hollow conical element, taken parallel to an upper surface of the ground plane, decreases as it moves away from the ground plane. In each case (a-d), the cross section of each 3D radiating element of the plurality of 3D radiating elements can be a circle, with the greatest width being a diameter of the circle, or the cross section of each 3D radiating element of the plurality of 3D radiating elements can be a polygon (e.g., a hexagon). The method can further comprise disposing a substrate (e.g., a PCB substrate or a dielectric substrate) on the ground plane, the substrate having a plurality of holes therein for the plurality of 3D radiating elements, respectively. The substrate can be disposed to be in direct physical contact with the ground plane, the plurality of 3D radiating elements, or both.

BRIEF DESCRIPTION OF DRAWINGS

FIG. 8A shows a perspective view of a reflectarray including a plurality of 3D radiating elements, according to an embodiment of the subject invention. The reflectarray has many unit cells, each with a radiating element, and many (though not all) of the radiating elements are 3D radiating elements. In the reflectarray depicted in FIG. 8A, the 3D radiating elements are inverted, full conical elements. Also, the reflectarray includes a substrate (e.g., a dielectric or PCB substrate) disposed on the ground plane and has holes for each 3D radiating element, respectively. The substrate is in direct physical contact with the ground plane and the 3D radiating elements.

FIG. 8B shows a close-up view of a portion of the reflectarray shown in FIG. 8A.

FIG. 8C shows a side view of the reflectarray shown in FIG. 8A.

DETAILED DESCRIPTION

Embodiments of the subject invention provide novel and advantageous antenna arrays (e.g., reflectarrays and transmitarrays) with three-dimensional (3D) radiating elements, as well as methods of manufacturing and methods of using the same. An array can include a ground plane and a plurality of radiating elements disposed thereon, and at least a portion of the radiating elements of the plurality of radiating elements can be 3D radiating elements. The array can optionally include a substrate disposed on the ground plane and having holes for the radiating elements. The 3D radiating elements can include, for example, conical elements such as a hollow conical element, a full conical element, a hollow and discretized conical element, or a combination thereof. The conical elements can either be standard (with the side having the smaller radius or width of the cross-sectional shape of the element being on the ground plane) or inverted (with the side having the larger radius or width of the cross-sectional shape of the element being on the ground plane). The final radiating elements can comprise a conductive material, including but not limited to copper, silver, aluminium, gold, platinum, palladium, and/or steel. The array can be made by, for example, printing it (e.g., 3D printing) with a polymer (e.g., a plastic such as a thermoplastic and/or amorphous polymer such as acrylonitrile butadiene styrene (ABS)) or a similar material. The array can then be metallized with one or more metals (e.g., copper, silver, aluminium, gold, platinum, palladium, and/or steel).

Figure 5:
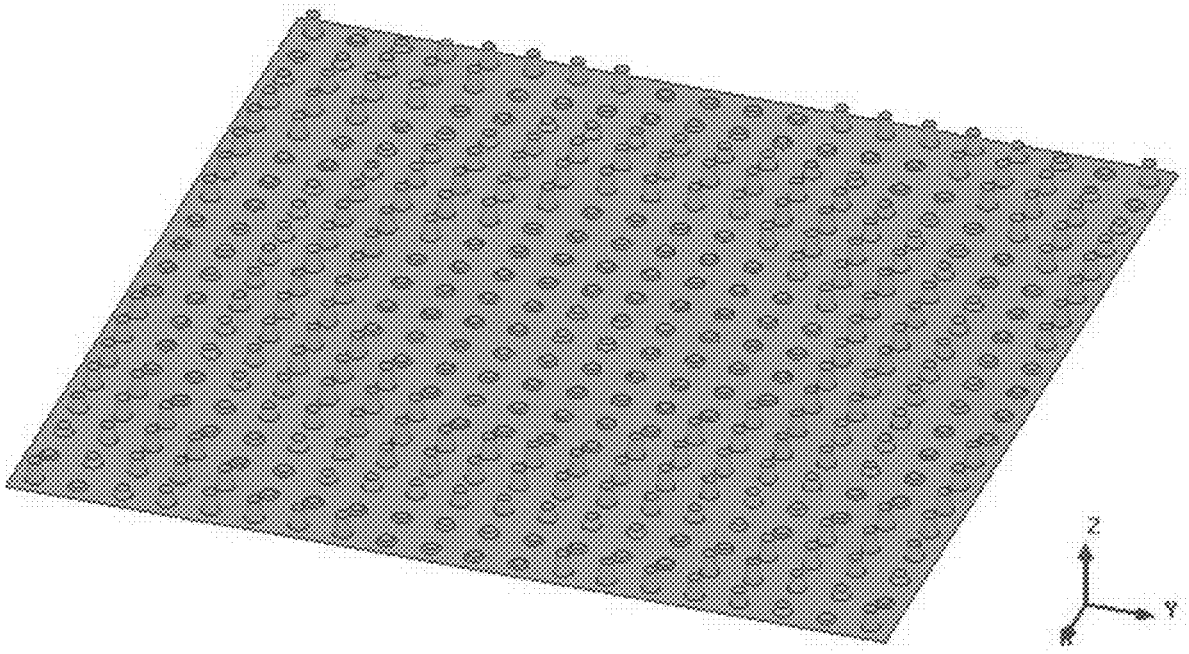
FIG. 5 shows a perspective view of a reflectarray including a plurality of 3D radiating elements, according to an embodiment of the subject invention. The reflectarray has many unit cells, each with a radiating element, and many (though not all) of the radiating elements are 3D radiating elements. In the reflectarray depicted in FIG. 5, the 3D radiating elements are inverted, full conical elements.

The array (e.g., the ground plane of the array) can include a plurality of unit cells, each unit cell including a single radiating element disposed on the ground plane. Some or all of the radiating elements can be 3D radiating elements. FIG. 5 shows a perspective view of a reflectarray including a plurality of 3D radiating elements, according to an embodiment of the subject invention. Referring to FIG. 5, the reflectarray has an array (20×20 as depicted in FIG. 5) of unit cells, each with a radiating element. Many (though not all) of the radiating elements are 3D radiating elements. In the reflectarray depicted in FIG. 5, the 3D radiating elements are inverted, full conical elements. In alternative embodiments, different shapes can be used for the 3D radiating elements, and/or the 3D radiating elements can be disposed in different unit cell position (including, for example, the case where every unit cell has a 3D radiating element).

Figure 1:
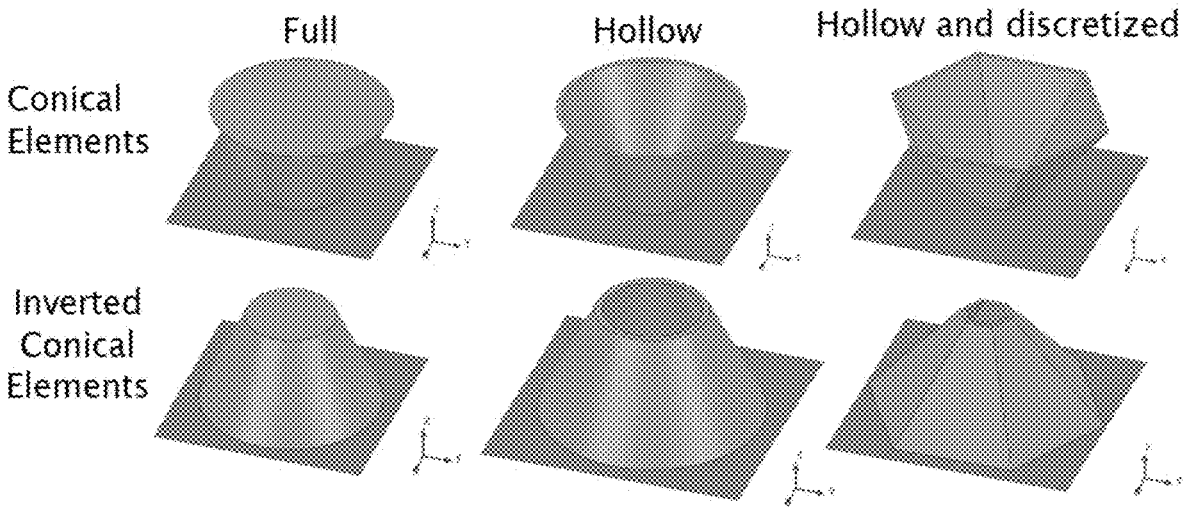
FIG. 1 is a schematic view showing six different shapes of three-dimensional (3D) radiating elements that can be used with arrays according to embodiments of the subject invention. The top-left radiating element is a full (i.e., filled in or not hollow) conical element; the top-middle radiating element is a hollow conical element; the top-right radiating element is a discretized, hollow conical element; the bottom-left radiating element is an inverted, full conical element; the bottom-middle radiating element is an inverted, hollow conical element; and the bottom-right radiating element is an inverted, discretized, hollow conical element.

FIG. 1 is a schematic view showing six different shapes of 3D radiating elements that can be used with arrays according to embodiments of the subject invention. The top-left radiating element is a full (i.e., filled in or not hollow) conical element; the top-middle radiating element is a hollow conical element; the top-right radiating element is a discretized, hollow conical element; the bottom-left radiating element is an inverted, full conical element; the bottom-middle radiating element is an inverted, hollow conical element; and the bottom-right radiating element is an inverted, discretized, hollow conical element. The conical elements have a cross-section (taken in a direction parallel to the ground plane surface on which the element is disposed) that either increases in diameter or greatest width as you move away from the ground plane or decreases in diameter or greatest width as you move away from the ground plane (the latter case is referred to herein as an "inverted" conical element). The conical elements need not be full cones that taper all the way to a point; instead, the conical elements can have a lampshade-style shape as shown in FIG. 1. The conical elements can have a circular cross-section (as shown in the top-left, top-middle, bottom-left, and bottom-middle of FIG. 1). Alternatively, the conical elements can have a polygonal cross-section (as shown in the top-right and bottom-right of FIG. 1). Though FIG. 1 shows a hexagonal cross-sectional shape, this is for exemplary purposes only and should not be construed as limiting. Other polygonal cross-sectional shapes can be used. Conical elements with a polygonal cross-sectional shape can be referred to herein as "discretized" conical elements. Discretized conical elements can be hollow (as shown in the top-right and bottom-right of FIG. 1) or full (similar to that shown in the top-left and bottom-left of FIG. 1, but with a polygonal cross-sectional shape instead of a circular cross-sectional shape).

Referring to FIGS. 6A, 6B, 6C, 8A, 8B, and 8C, in certain embodiments, a reflectarray can include a substrate (e.g., a dielectric or printed circuit board (PCB) substrate) disposed on the ground plane on which the 3D radiating elements are disposed. The substrate can have holes for the 3D radiating element, respectively. The substrate can be in direct physical contact with the ground plane, the 3D radiating element(s), or both. As shown in FIG. 8A-8C, the substrate can be a single, monolithic substrate that can be in direct physical contact with the ground plan and all 3D radiating element. Although FIGS. 6A-6C and 8A-8C depict an inverted, full conical 3D radiating element for each 3D radiating element, this is for exemplary purposes only. The embodiments with a substrate disposed on the ground plane can include any of the 3D radiating element shapes disclosed herein (e.g., any of the shapes depicted in FIG. 1). The substrate layer can be made using, for example, a PCB or dielectric material (e.g., Teflon, plastic ABS, polytetrafluoroethylene (PTFE)), though embodiments are not limited thereto. The substrate layer can reduce specular reflection of the incident wave that occurs due to the presence of the ground reflection plane. This can lead to improved efficiency and gain performance of the array.

The reflection phase of the 3D radiating elements of embodiments of the subject invention has a linear response versus frequency (see, e.g., FIGS. 4A and 7), and arrays using such 3D radiating elements can achieve broadband operation. Also, the arrays using such 3D radiating elements can have significantly wider operational bandwidth than arrays with traditional rectangular patch elements. The frequencies where the absolute value of the unit-cell's phase is 45° define the upper and lower frequency limits, which in turn define the bandwidth. This bandwidth is a representation of how fast the element phase varies with frequency, and it is typically around 6.2% (which is considered narrowband) for a classical microstrip patch element (see, e.g., FIGS. 3B and 4B). Arrays of embodiments of the subject invention can have a bandwidth of, for example, any of the following values, about any of the following values, at least any of the following values, not more than any of the following values, or within any range having any of the following values as endpoints (all numerical values are in percent (%)): 10, 15, 20, 25, 30, 32, 35, 40, 41.5, 45, or 50. For example, an array with inverted, full conical elements can have a bandwidth of 41.5%.

Figure 2:
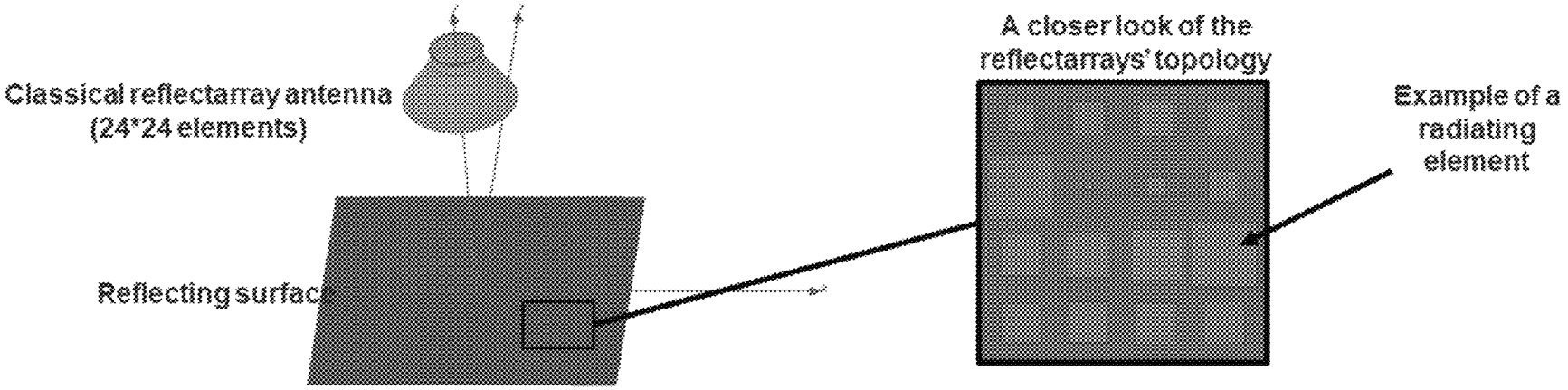
FIG. 2 is a schematic view showing an array and antenna.

FIG. 2 is a schematic view showing an array and an antenna. Referring to FIG. 2, a reflectarray is an antenna including a reflecting surface (flat or a slightly curved), where an illuminating feed antenna can be used to provide radiation to the reflecting surface. The reflecting surface includes radiating elements, and the feed antenna spatially illuminates the radiating elements that are designed to reradiate and scatter the incident field with electrical phases that are required to form a planar phase front in the far-field distance. Different methods can be used for reflectarray elements to achieve a planar phase front. FIG. 2 shows use of variable-size patches, enabling the elements to have different scattering impedances and, thus, different phases to compensate for the different feed-path delays.

Embodiments of the subject invention provide arrays with 3D radiating elements that can provide broadband operation while having a low-cost and easy fabrication. These arrays can be used in several fields, including but not limited to 5G communications, multi-functional communications, terrestrial communications, extra-terrestrial communications, and satellite communication systems.

The term 3D radiating element, as used herein, requires that the radiating element extends significantly (e.g., a distance that is at least 30% of a diameter or greatest width of the radiating element) above the surface of the ground plane on which it is disposed. That is, while traditional patch-style radiating elements may in some cases have some incidental amount of conductive material that extends above the surface of the ground plane, this will be negligible in height compared to the width of the patch element and, therefore, patch radiating elements are not included in the term 3D radiating elements.

When the term "about" is used herein, in conjunction with a numerical value, it is understood that the value can be in a range of 95% of the value to 105% of the value, i.e. the value can be +/−5% of the stated value. For example, "about 1 kg" means from 0.95 kg to 1.05 kg.

A greater understanding of the embodiments of the subject invention and of their many advantages may be had from the following examples, given by way of illustration. The following examples are illustrative of some of the methods, applications, embodiments, and variants of the embodiments of the subject invention. They are, of course, not to be considered as limiting the invention. Numerous changes and modifications can be made with respect to the invention.

Example 1

Figure 3A:
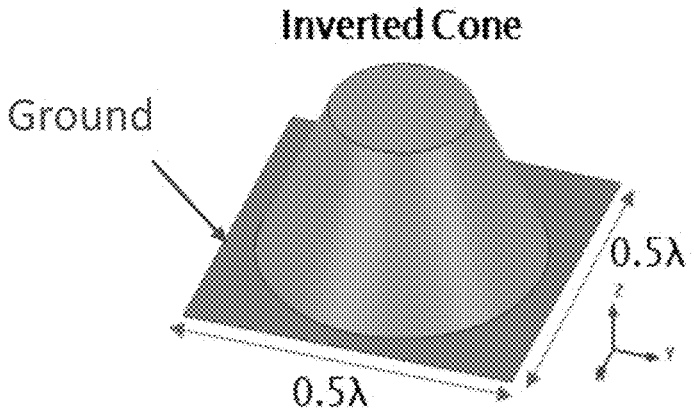
FIG. 3A is a schematic view showing an inverted, full conical 3D radiating element that can be used with an array, according to an embodiment of the subject invention. The unit cell of the ground plane on which the 3D radiating element is disposed is depicted as having a dimension (width and length) of 0.5 times the wavelength (λ) of the electromagnetic radiation applied to the array.
Figure 3B:
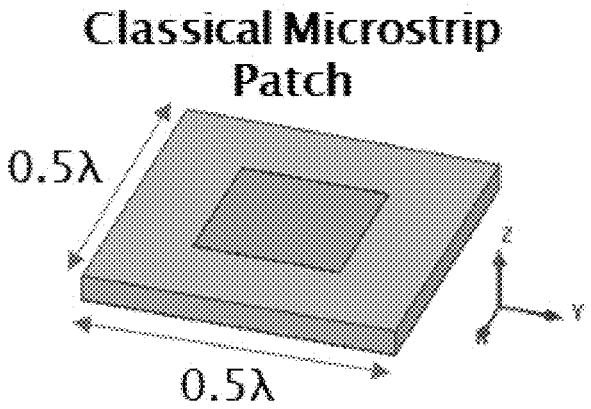
FIG. 3B is a schematic view showing a classical microstrip patch radiating element that can be used with an array. The unit cell of the ground plane on which the radiating element is disposed is depicted as having a dimension (width and length) of 0.5 times the wavelength (λ) of the electromagnetic radiation applied to the array.

A unit cell of a reflectarray as shown in FIG. 3A (3D inverted, full conical element) was fabricated with plastic ABS using a 3D printer and then metallized with a conductive metal. The phase response (in degrees) versus frequency (in GHz) was tested compared to that of a classical microstrip patch unit cell (as shown in FIG. 3B) using the same conductive metal as the patch. In both cases the length and width of the unit cell was 0.5 times the wavelength (λ) of the electromagnetic radiation applied to the unit cell.

Figure 4A:
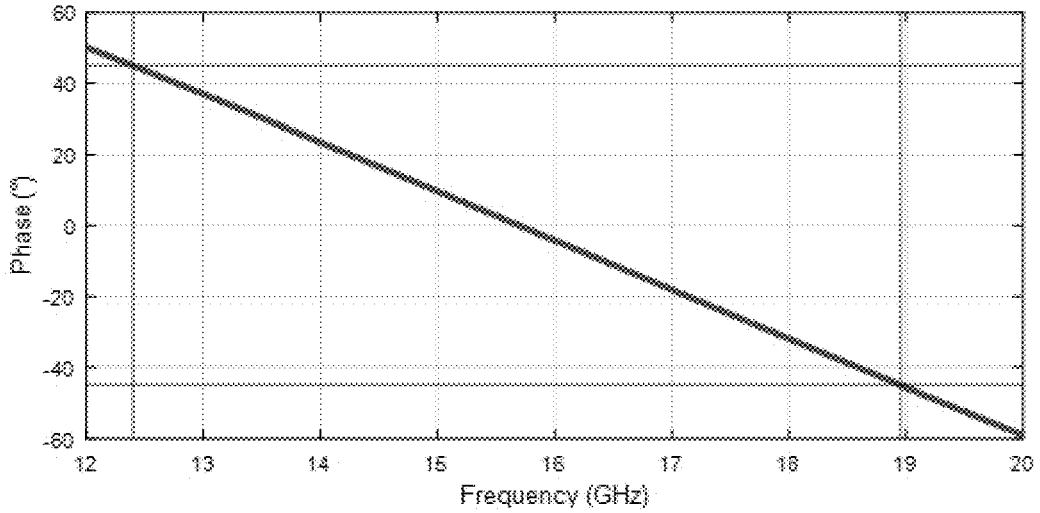
FIG. 4A shows a plot of phase (in degrees) versus frequency (in gigahertz (GHz)) for a reflectarray unit cell as shown in FIG. 3A, with a dimension (width and length) of 0.5 times the wavelength (λ) of the electromagnetic radiation applied to the array.
Figure 4B:
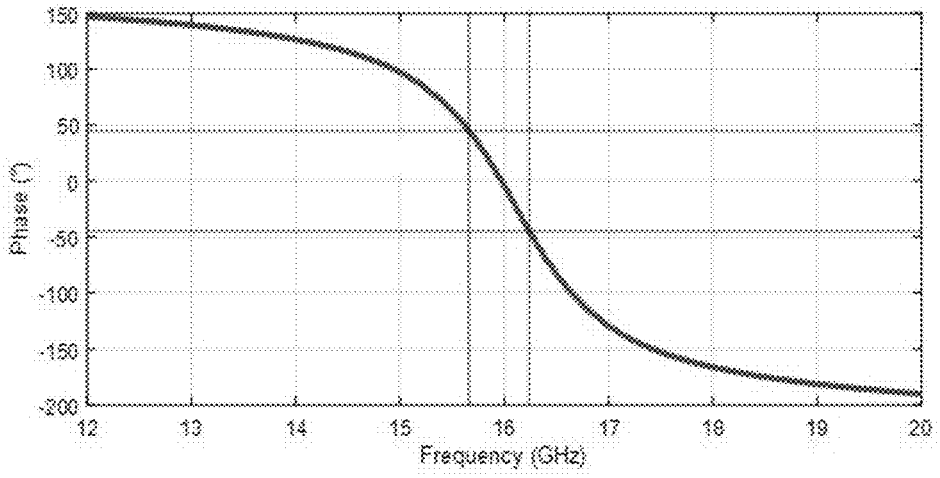
FIG. 4B shows a plot of phase (in degrees) versus frequency (in gigahertz (GHz)) for a reflectarray unit cell as shown in FIG. 3B, with a dimension (width and length) of 0.5 times the wavelength (λ) of the electromagnetic radiation applied to the array.

FIGS. 4A and 4B show the results for the unit cells of FIGS. 3A and 3B, respectively. The bandwidth for the classical microstrip patch radiating element was 6.2% (narrowband), while the bandwidth for the 3D radiating element was 41.5%, which is almost seven times larger than that of the classical microstrip patch radiating element. This shows that wideband arrays (e.g., reflectarrays or transmitarrays) can be developed using the 3D radiating elements (unit cells) of embodiments of the subject invention.

Example 2

Figure 6A:
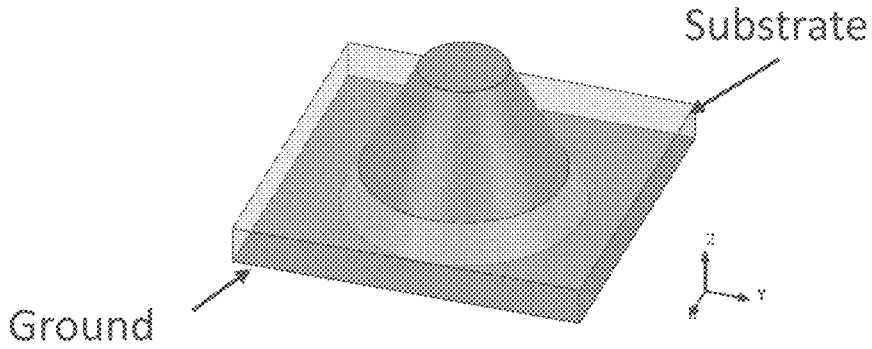
FIG. 6A shows an inverted, full conical 3D radiating element that can be used with an array, according to an embodiment of the subject invention. The unit cell of the ground plane on which the 3D radiating element is disposed is depicted as having a dimension (width and length) of 0.5 times the wavelength (λ) of the electromagnetic radiation applied to the array. A substrate (e.g., a dielectric or printed circuit board (PCB) substrate) can be disposed on the ground plane and can have a hole for the 3D radiating element (e.g., a plurality of holes for a plurality of 3D radiating elements, respectively). The substrate can be in direct physical contact with the ground plane, the 3D radiating element(s), or both.
Figure 6B:
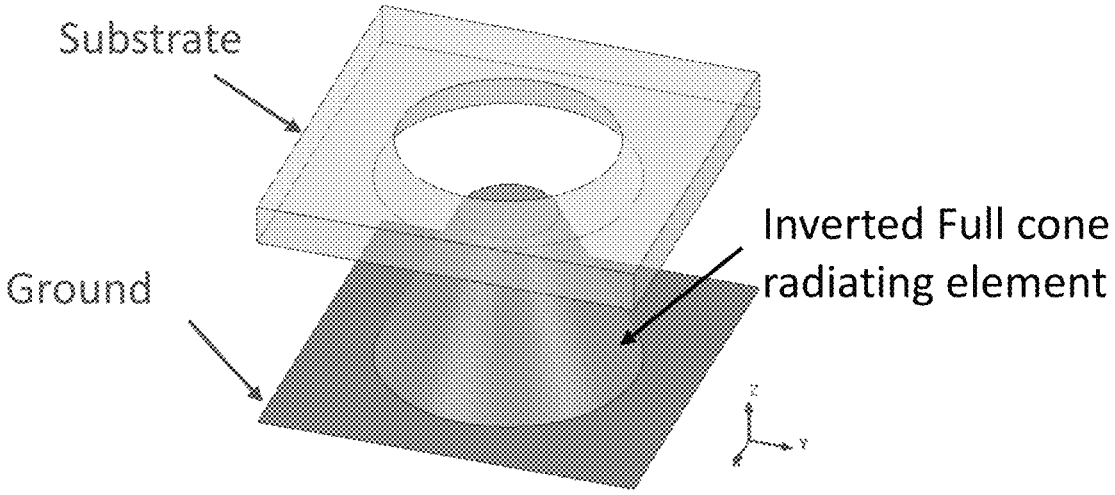
FIG. 6B shows an exploded view of the unit cell shown in FIG. 6A.
Figure 6C:
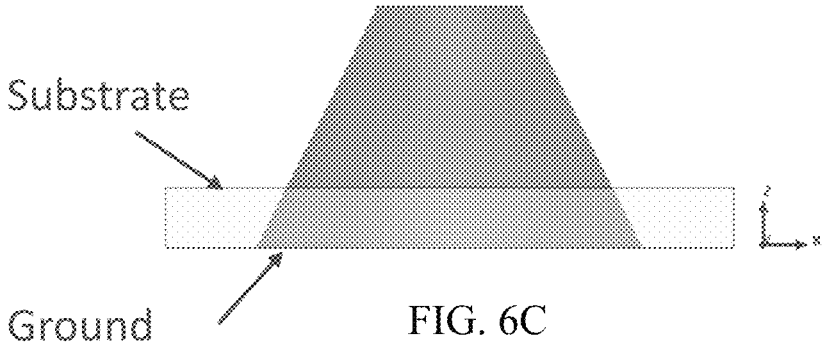
FIG. 6C shows a side view of the unit cell shown in FIG. 6A.

A unit cell of a reflectarray as shown in FIGS. 6A-6C (3D inverted, full conical element) was fabricated with plastic ABS using a 3D printer and then metallized with a conductive metal. A Rogers 4003 dielectric substrate layer was disposed on the ground plane, with a hole for the 3D radiating element, in direct physical contact with the ground plane and the 3D radiating element. The phase response (in degrees) versus frequency (in GHz) was tested as in Example 1. The length and width of the unit cell was 0.5 times the wavelength (λ) of the electromagnetic radiation applied to the unit cell.

Figure 7:
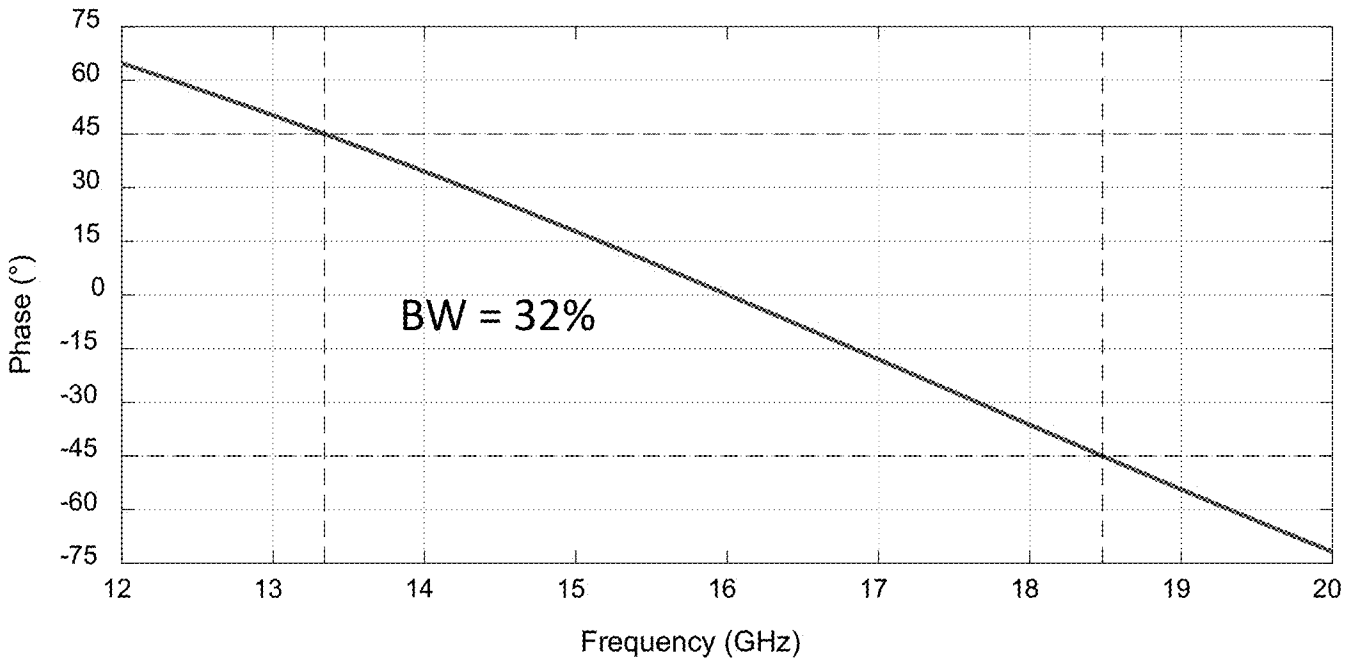
FIG. 7 shows a plot of phase (in degrees) versus frequency (in gigahertz (GHz)) for a reflectarray unit cell as shown in FIGS. 6A-6C, with a dimension (width and length) of 0.5 times the wavelength (λ) of the electromagnetic radiation applied to the array.

FIG. 7 shows the results. The bandwidth for the 3D radiating element as shown in FIGS. 6A-6C was 32%, which is more than five times larger than that of the classical microstrip patch radiating element (FIGS. 3B and 4B). This shows once again that wideband arrays (e.g., reflectarrays or transmitarrays) can be developed using the 3D radiating elements (unit cells) of embodiments of the subject invention.

It should be understood that the examples and embodiments described herein are for illustrative purposes only and that various modifications or changes in light thereof will be suggested to persons skilled in the art and are to be included within the spirit and purview of this application.

All patents, patent applications, provisional applications, and publications referred to or cited herein are incorporated by reference in their entirety, including all figures and tables, to the extent they are not inconsistent with the explicit teachings of this specification.

What is claimed is:

1. An antenna array, comprising:

a ground plane;

a plurality of three-dimensional (3D) radiating elements disposed on the ground plane, each 3D radiating element comprising a conductive material; and a single, monolithic substrate disposed on the ground plane and comprising a plurality of holes through which the plurality of 3D radiating elements are respectively disposed, the single, monolithic substrate being in direct physical contact with the ground plane and all 3D radiating elements of the plurality of 3D radiating elements, the single, monolithic substrate being a printed circuit board (PCB) or a dielectric substrate, the antenna array being a reflectarray or a transmitarray, a majority of each 3D radiating element of the plurality of 3D radiating elements protruding above an upper surface of the single, monolithic substrate, each 3D radiating element of the plurality of 3D radiating elements comprising a lowermost portion in direct physical contact with the ground plane and an uppermost portion opposite from the lowermost portion, each 3D radiating element of the plurality of 3D radiating elements being a conical element disposed on the ground plane such that a greatest width of a cross section of the conical element, taken parallel to an upper surface of the ground plane, either continuously increases from the lowermost portion to the uppermost portion as it moves away from the ground plane or continuously decreases from the lowermost portion to the uppermost portion as it moves away from the ground plane, and each hole of the plurality of holes of the single, monolithic substrate having a largest width that is at least as wide as a largest width of the respective 3D radiating element disposed therethrough.

2. The antenna array according to claim 1, each conical element being a hollow conical element disposed on the ground plane such that the greatest width of the cross section of the conical element, taken parallel to upper surface of the ground plane, increases as it moves away from the ground plane.

3. The antenna array according to claim 2, the cross section of each 3D radiating element of the plurality of 3D radiating elements being:

a circle and the greatest width being a diameter of the circle; or a polygon.

4. The antenna array according to claim 1, each conical being a filled-in conical element disposed on the ground plane such that the greatest width of the cross section of the conical element, taken parallel to the upper surface of the ground plane, increases as it moves away from the ground plane.

5. The antenna array according to claim 4, the cross section of each 3D radiating element of the plurality of 3D radiating elements being:

a circle and the greatest width being a diameter of the circle; or a polygon.

6. The antenna array according to claim 1, each conical element being a hollow conical element disposed on the ground plane such that the greatest width of the cross section of the conical element, taken parallel to the upper surface of the ground plane, decreases as it moves away from the ground plane.

7. The antenna array according to claim 6, the cross section of each 3D radiating element of the plurality of 3D radiating elements being:

a circle and the greatest width being a diameter of the circle; or a polygon.

8. The antenna array according to claim 1, each conical element being a filled-in conical element disposed on the ground plane such that the greatest width of the cross section of the conical element, taken parallel to the upper surface of the ground plane, decreases as it moves away from the ground plane.

9. The antenna array according to claim 8, the cross section of each 3D radiating element of the plurality of 3D radiating elements being:

a circle and the greatest width being a diameter of the circle; or a polygon.

10. The antenna array according to claim 1, each 3D radiating element of the plurality of 3D radiating elements comprising a polymer coated with the conductive material.

11. The antenna array according to claim 1, the ground plane comprising a plurality of unit cells, each unit cell of the plurality of unit cells comprising exactly one 3D radiating element of the plurality of 3D radiating elements.

12. The antenna array according to claim 1, the single, monolithic substrate being a PCB.

13. A method of fabricating an antenna array, the antenna array comprising a ground plane and a plurality of three-dimensional (3D) radiating elements disposed on the ground plane, the method comprising:

using a 3D printer to print the ground plane and the plurality of 3D radiating elements with a polymer;

metallizing the ground plane and the plurality of 3D radiating elements with a conductive metal; and disposing a single, monolithic substrate on the ground plane, the substrate comprising a plurality of holes through which the plurality of 3D radiating elements are respectively disposed, the single, monolithic substrate being in direct physical contact with the ground plane and all 3D radiating elements of the plurality of 3D radiating elements, the single, monolithic substrate being a printed circuit board (PCB) or a dielectric substrate, the antenna array being a reflectarray or a transmitarray, a majority of each 3D radiating element of the plurality of 3D radiating elements protruding above an upper surface of the single, monolithic substrate, each 3D radiating element of the plurality of 3D radiating elements comprising a lowermost portion in direct physical contact with the ground plane and an uppermost portion opposite from the lowermost portion, each 3D radiating element of the plurality of 3D radiating elements being a conical element disposed on the ground plane such that a greatest width of a cross section of the conical element, taken parallel to an upper surface of the ground plane, either continuously increases from the lowermost portion to the uppermost portion as it moves away from the ground plane or continuously decreases from the lowermost portion to the uppermost portion as it moves away from the ground plane, and each hole of the plurality of holes of the single, monolithic substrate having a largest width that is at least as wide as a largest width of the respective 3D radiating element disposed therethrough.

14. The method according to claim 13, the polymer being a thermoplastic, an amorphous polymer, or both.

15. The method according to claim 13, the ground plane comprising a plurality of unit cells, each unit cell of the plurality of unit cells comprising exactly one 3D radiating element of the plurality of 3D radiating elements.

16. An antenna array, comprising:

a ground plane;

a plurality of three-dimensional (3D) radiating elements disposed on the ground plane, each 3D radiating element comprising a conductive material; and a single, monolithic substrate disposed on the ground plane and comprising a plurality of holes through which the plurality of 3D radiating elements are respectively disposed, the single, monolithic substrate being in direct physical contact with the ground plane and all 3D radiating elements of the plurality of 3D radiating elements, the single, monolithic substrate being a printed circuit board (PCB) or a dielectric substrate, the antenna array being a reflectarray or a transmitarray, each 3D radiating element of the plurality of 3D radiating elements comprising a polymer coated with the conductive material, the conductive material comprising at least one of copper, silver, aluminium, gold, platinum, palladium, and steel, the polymer being a thermoplastic, an amorphous polymer, or both, the ground plane comprising a plurality of unit cells, each unit cell of the plurality of unit cells comprising exactly one 3D radiating element of the plurality of 3D radiating elements, a majority of each 3D radiating element of the plurality of 3D radiating elements protruding above an upper surface of the single, monolithic substrate, each 3D radiating element of the plurality of 3D radiating elements comprising a lowermost portion in direct physical contact with the ground plane and an uppermost portion opposite from the lowermost portion, each 3D radiating element of the plurality of 3D radiating elements being a conical element disposed on the ground plane such that a greatest width of a cross section of the conical element, taken parallel to an upper surface of the ground plane, either continuously increases from the lowermost portion to the uppermost portion as it moves away from the ground plane or continuously decreases from the lowermost portion to the uppermost portion as it moves away from the ground plane, that is at least as wide as a largest width of the respective 3D radiating element disposed therethrough, and each conical element being:

a) a hollow conical element disposed on the ground plane such that the greatest width of the cross section of the conical element, taken parallel to the upper surface of the ground plane, increases as it moves away from the ground plane;

b) a filled-in conical element disposed on the ground plane such that the greatest width of the cross section of the conical element, taken parallel to the upper surface of the ground plane, increases as it moves away from the ground plane;

c) a hollow conical element disposed on the ground plane such that the greatest width of the cross section of the hollow conical element, taken parallel to the upper surface of the ground plane, decreases as it moves away from the ground plane; or d) a filled-in conical element disposed on the ground plane such that the greatest width of the cross section of the hollow conical element, taken parallel to the upper surface of the ground plane, decreases as it moves away from the ground plane.

* * * * *